US005489813A

United States Patent [19]

Jung

[11] Patent Number: 5,489,813

[45] Date of Patent: Feb. 6, 1996

[54] NEON LAMP

[76] Inventor: Huang H. Jung, P.O. Box 82-144, Taipei, Taiwan

[21] Appl. No.: 173,892

[22] Filed: Dec. 27, 1993

[51] Int. Cl.[6] ..... H01J 1/02

[52] U.S. Cl. ..... 313/25; 313/51

[58] Field of Search ..... 313/25, 51, 573, 313/619, 634, 312; 439/226, 234, 235, 236

[56] References Cited

U.S. PATENT DOCUMENTS

| | | | |
|---|---|---|---|
| 2,356,601 | 8/1944 | MacCathy | 313/25 |
| 3,974,418 | 8/1976 | Fridrich | 315/59 |
| 3,996,493 | 12/1976 | Davenport | 315/58 |
| 4,092,562 | 5/1978 | Campbell | 315/189 |
| 4,352,539 | 10/1982 | Vest | 339/154 L |
| 4,449,071 | 5/1984 | Yokoyama | 315/53 |
| 4,726,781 | 2/1988 | Bernhart | 439/228 |
| 4,875,871 | 10/1989 | Booty, Sr. | 439/209 |

*Primary Examiner*—Michael T. Razavi
*Assistant Examiner*—Tuan V. Ho
*Attorney, Agent, or Firm*—Alfred Lei

[57] ABSTRACT

A neon lamp including a transparent outer tube, a neon bulb fitted in said transparent outer tube and provided at one end with a transformer for converting AC power supply into required voltage, a tubular member inserted into said transparent outer tube for receiving connecting wires, a plug mounted on one end of said transparent outer tube and having a flange and a pair of metallic prongs, and a socket mounted another end of said transparent outer tube and having a flange and a pair of holes each provided with a metallic sleeve, the holes of said socket being adapted to receive the metallic prongs of another plug.

1 Claim, 6 Drawing Sheets

NEON LAMP

BACKGROUND OF THE INVENTION

It has been found that the conventional neon lamps are made into desired shapes in advance and tied or adhered together to form a predetermined pattern. However, it is time-consuming and inconvenient to assemble the neon lamps into a predetermined pattern and furthermore, the neon lamps will become useless and have to be disposed of after use.

Therefore, it is an object of the present invention to provide an improved neon lamp which can obviate and mitigate the above-mentioned drawbacks.

SUMMARY OF THE INVENTION

This invention relates to an improved neon lamp.

It is the primary object of the present invention to provide a neon lamp which can be easily connected with another one.

It is another object of the present invention to provide a neon lamp which can be connected with another one at an angular position.

It is still another object of the present invention to provide a neon lamp which can prevent water from entering therein.

It is still another object of the present invention to provide a neon lamp which is simple in construction.

It is a further object of the present invention to provide a neon lamp which is fit for practical use.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Figure 1:
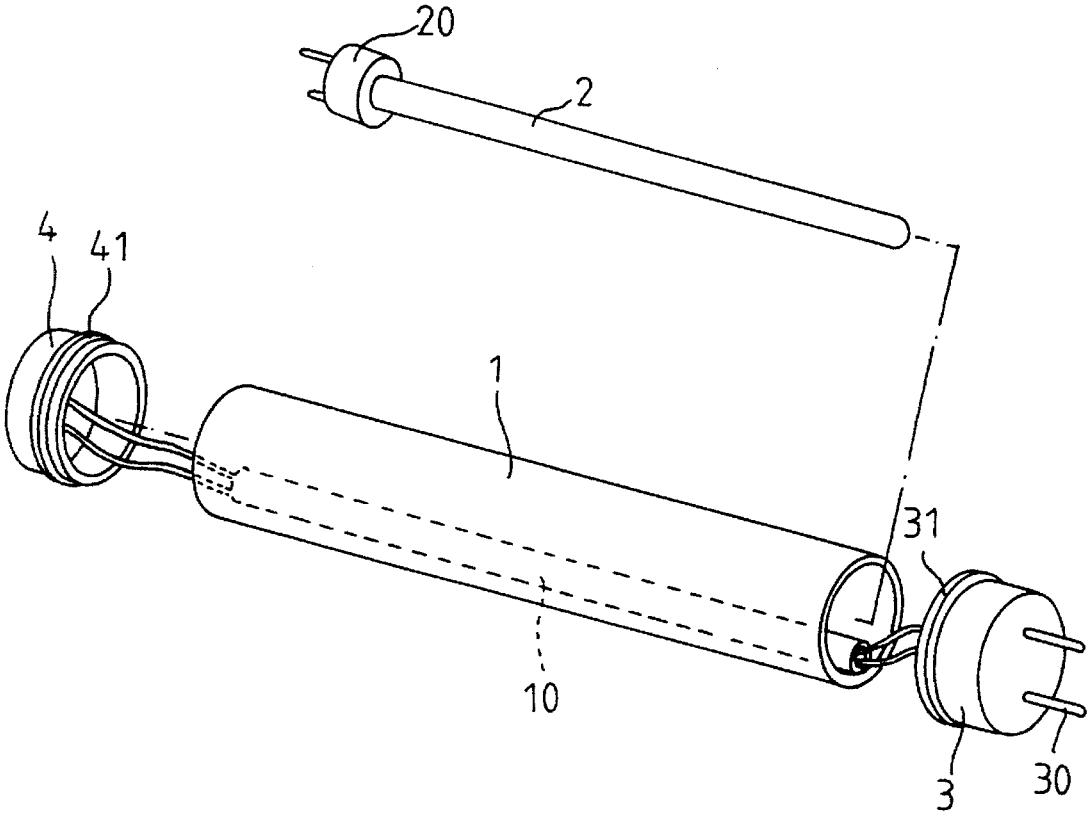
FIG. 1 is a perspective view of a neon lamp according to the present invention.

For purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
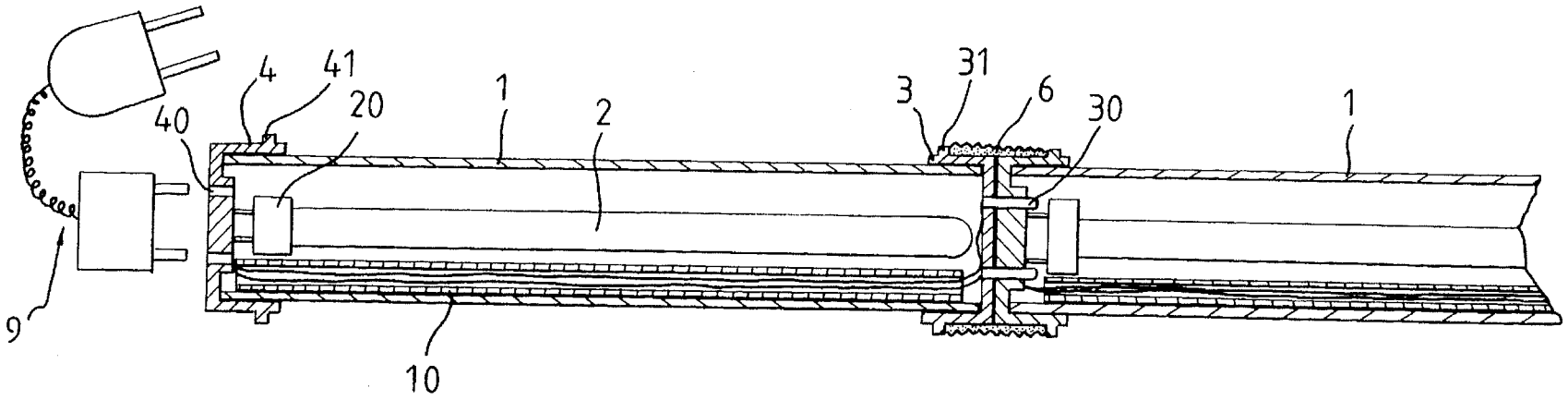
FIG. 2 is a sectional view showing the connection between two neon lamps.
Figure 5A:
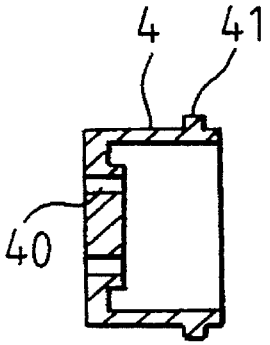
FIG. 5A is a sectional view of the plug.
Figure 5B:
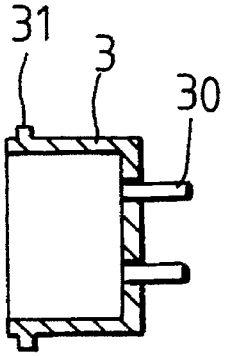
FIG. 5B is a sectional view of the plug.

With reference to the drawings and in particular to FIGS. 1 and 2 thereof, the neon lamp according to the present invention comprises a transparent outer tube 1 in which is fitted a neon bulb 2. The neon bulb 2 is provided at one end with a transformer 20 for converting the AC power supply into required voltage for the neon bulb 2. A tubular member 10 is inserted into the transparent outer tube 1 for receiving connecting wires. The transparent outer tube 1 is connected with a plug 3 at one end and a socket 4 at the other. As shown in FIGS. 5A and 5B, the plug 3 is formed with a flange 31 and a pair of metallic prongs 30, while the socket 4 with a flange 41 and a pair of holes 40 in each of which is inserted a metallic sleeve (not shown). The holes 40 of the socket 4 are adapted to receive the prongs 30 of the plug 3 so that a plurality of transparent outer tubes 1 can be conveniently connected together. Further, the socket 4 is connected with the plug 3 by wires enclosed in the tubular member 10 and may be connected with the power supply through a power cord 9.

Figure 4A:
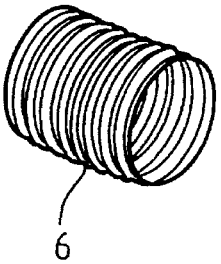
FIG. 4A is a perspective view of the rubber member.
Figure 4B:
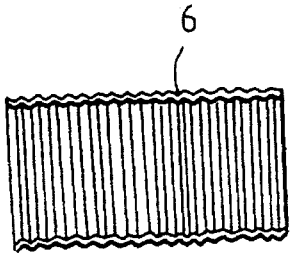
FIG. 4B is a sectional view of the rubber member.

A rubber member 6 can be fitted between the flange 31 of the plug 3 and the flange 41 of the socket 4 so as to prevent water from flowing into the transparent outer tubes 1 (see FIGS. 2, 4A and 4B).

Figure 3A:
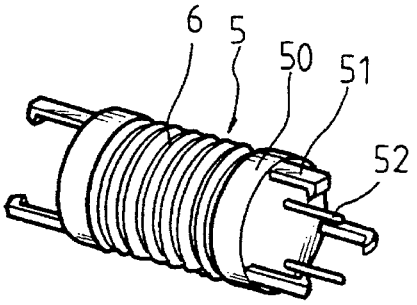
FIG. 3A is a perspective view of the flexible connector.
Figure 3B:
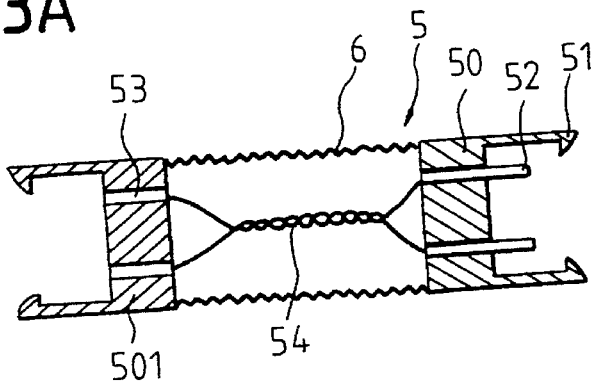
FIG. 3B is a sectional view of the flexible connector.

In order to enable a neon lamp to connect another one at an angular position, a flexible connector 5 is provided. As illustrated in FIGS. 3A and 3B, the flexible connector 5 is provided at one end with a male seat 50 having a plurality of hooks 51 and a pair of metallic pins 52 and at the other end with a female seat 501 having a plurality of hooks 51 and two holes 53 in each of which is mounted a metallic sleeve (not shown). Further, there is a rubber tubular member 6 mounted between the male seat 50 and the female seat 501 for preventing water from entering therein. In addition, the metallic sleeves (not shown) in the holes 53 of the female seat 501 are connected with the metallic pins 52 of the male seat 50 via an electrical wire 54.

Figure 6:
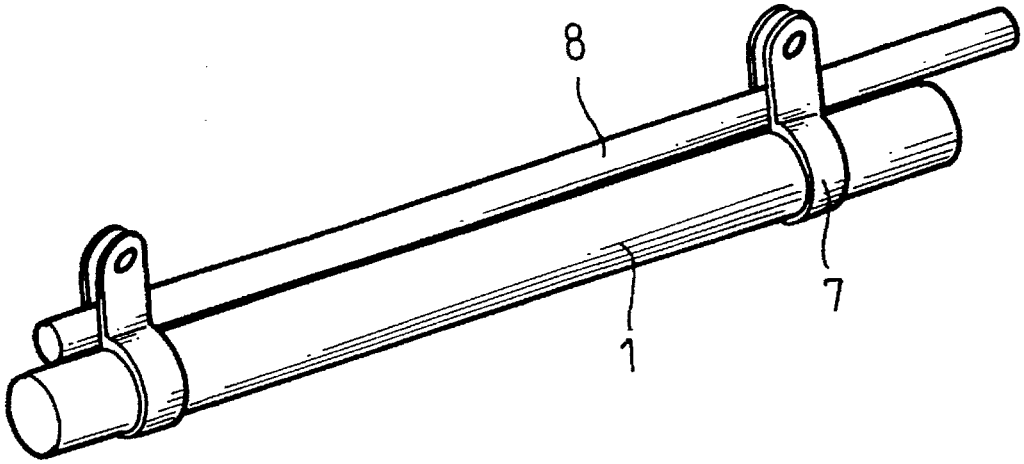
FIG. 6 shows the way to use the neon lamp as an illuminating means.

Hence, the neon lamps can be conveniently connected at angular positions thereby enabling the neon lamps to be connected to form different patterns. Moreover, when not in use, simply disconnect the neon lamps from one another, waiting for use in next time. If desired to change the pattern, it is only necessary to reorganize the connections between the neon lamps. However, it should be noted that the outer transparent outer tube 1 and the neon bulb 2 can be manufactured into any desired shape. Further, when desired to use the neon lamp as an illuminating means, simply mount two fixing members 7 on the neon lamp and connect the fixing members 7 with a supporting rod 8 (see FIG. 6).

Figure 7:
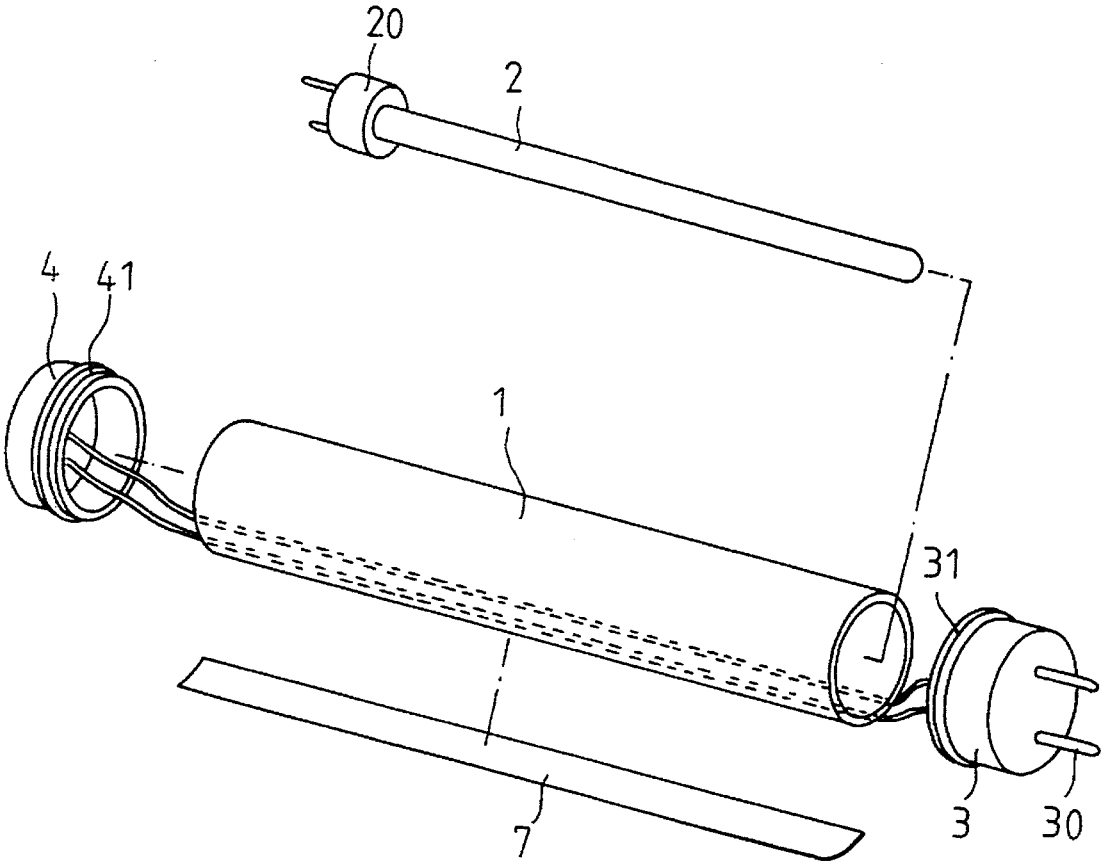
FIG. 7 shows another preferred embodiment of the present invention.

FIG. 7 shows another preferred embodiment of the present invention wherein the electrical wires are directly kept on the outer surface of the transparent outer tube 1 by a strip of tape 7.

Figure 8:
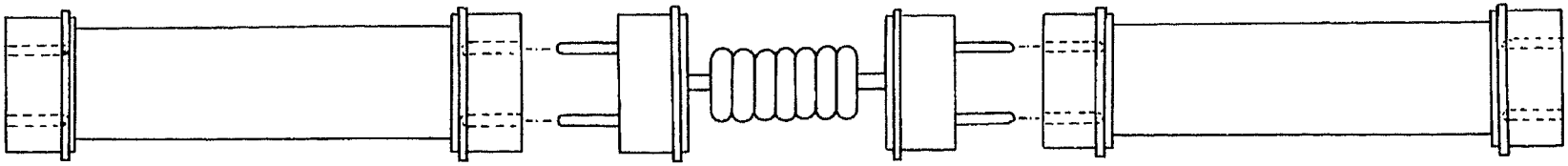
FIG. 8 shows a third preferred embodiment of the present invention.

FIG. 8 shows a third preferred embodiment of the present invention. As illustrated, both ends of the transparent outer tube 1 are provided with a socket 4 so that two transparent tubes 1 can be connected together via an extension cord with a plug at both ends.

Figure 9:
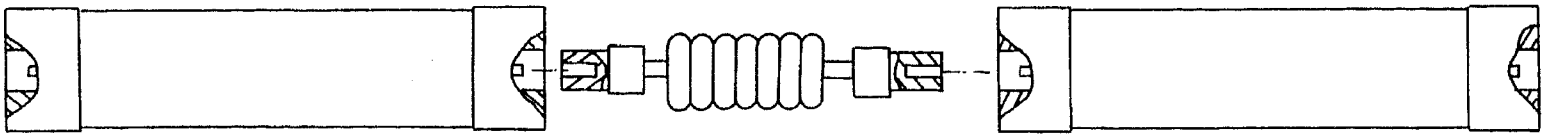
FIG. 9 shows a fourth preferred embodiment of the present invention.

FIG. 9 shows a fourth preferred embodiment of the present invention. As may be seen, the transparent outer tube 1 is provided with a socket at the center of both ends so that two transparent tubes 1 can be electrically connected by an extension cord with corresponding plugs.

Figure 10:
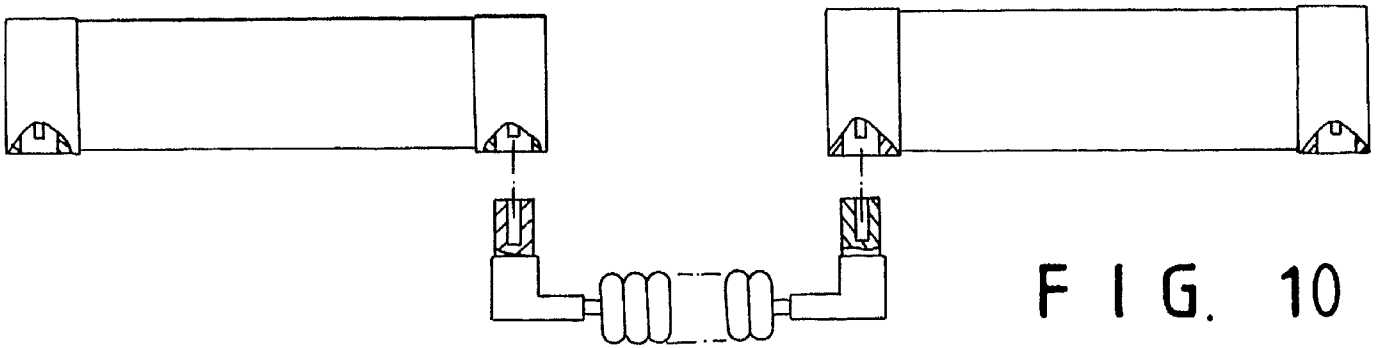
FIG. 10 shows a fifth preferred embodiment of the present invention.

FIG. 10 shows a fifth preferred embodiment of the present invention. As illustrated, the transparent outer tube 1 is provided at both ends with a socket which is vertically disposed with respect to the longitudinal axis of the transparent outer tube 1 and can be connected with another one via an extension cord with corresponding plugs.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A neon lamp comprising:

a transparent outer tube;

a neon bulb fitted in said transparent outer tube and provided at one end with a transformer for converting AC power supply into required voltage;

a tubular member inserted into said transparent outer tube for receiving connecting wires;

a plug mounted on one end of said transparent outer tube and having a flange and a pair of metallic prongs;

a socket mounted on the other end of said transparent outer tube and having a flange and a pair of holes each provided with a metallic sleeve, the holes of said socket being adapted to receive the metallic prongs of another plug; and a flexible connector provided at one end with a male seat having a plurality of hooks and a pair of metallic pins and at the other end with a female seat having a plurality of hooks and two holes in each of which is mounted a metallic sleeve, and a rubber sleeve mounted between said male seat and said female seat, the metallic pins of said flexible connector being adapted to engage said socket, the holes of said flexible sleeve being adapted to engage said plug.

* * * * *